US007182000B1

(12) United States Patent
Dicksen

(10) Patent No.: US 7,182,000 B1
(45) Date of Patent: Feb. 27, 2007

(54) ADAPTABLE HAND TOOL

(76) Inventor: Walter M. Dicksen, 94 Sidney School Rd., Annandale, NJ (US) 08801

( * ) Notice: Subject to any disclaimer, the term of this patent is extended or adjusted under 35 U.S.C. 154(b) by 273 days.

(21) Appl. No.: 10/447,627

(22) Filed: May 30, 2003

(51) Int. Cl.
*B25B 23/16* (2006.01)
*B25B 1/04* (2006.01)

(52) U.S. Cl. ..... 81/177.2; 81/177.5; 81/177.6

(58) Field of Classification Search ..... 81/177.2, 81/177.5, 177.6, 177.75, 177.85
See application file for complete search history.

(56) References Cited

U.S. PATENT DOCUMENTS

| | | | | |
|---|---|---|---|---|
| 3,039,339 | A * | 6/1962 | Hanson | 81/177.2 |
| 4,586,406 | A | 5/1986 | Howard | 81/177.2 |
| 5,109,737 | A | 5/1992 | Raber | 81/177.2 |
| 5,230,263 | A | 7/1993 | Kwaka | 81/125.1 |
| 5,305,668 | A | 4/1994 | Davis | 81/177.7 |
| 5,570,617 | A | 11/1996 | Love | 81/177.2 |
| 5,690,006 | A | 11/1997 | Pulliam | 81/177.2 |
| 5,911,798 | A | 6/1999 | Arnold | 81/177.2 |
| 5,960,684 | A | 10/1999 | Bosley | 81/177.8 |
| 6,000,299 | A | 12/1999 | Cole | 81/60 |
| 6,112,625 | A | 9/2000 | Turtle | 81/177.2 |
| 6,286,396 | B1 | 9/2001 | Johnson | 81/60 |
| 6,382,058 | B1 | 5/2002 | Owoc | 81/177.9 |
| 6,427,564 | B1 * | 8/2002 | Nelson | 81/177.2 |
| 6,550,357 | B1 * | 4/2003 | Freeman | 81/177.2 |

* cited by examiner

*Primary Examiner*—Lee D. Wilson
*Assistant Examiner*—Alvin J. Grant
(74) *Attorney, Agent, or Firm*—Paul Maleson

(57) ABSTRACT

A flexible adaptable hand tool to facilitate access in constricted areas. It includes a working tool element engaging the bolt or other device to be manipulated, and a varying set of extension bar elements adapted to be removably affixed to the working tool element and to each other, providing a choice of lengths and angles between the hand of the user and the device to be manipulated. Adapters enabling the removable affixation of elements to each other are provided.

6 Claims, 4 Drawing Sheets

ADAPTABLE HAND TOOL

BACKGROUND

1. Field of the Invention

The present invention relates to hand tools adapted to be flexible in application and particularly adapted to be used in awkward areas and space and access restricted areas. It has particular usefulness where the point of application of the tool is both angularly and linearly displaced from the hands of the user. A particular but not limiting field of use lies in the repair and maintenance of engines in heavy equipment, boats, automotive vehicles, aircraft and the like, where sometimes the tightening or loosening of a single bolt is a difficult task because of the inaccessibility of its location. The invention comprises a selection of connectable bar elements of varying lengths and other aspects and the use of adapters to interconnect these elements. While a particularly useful application is the provision of a ratchet wrench, the invention is not limited to this embodiment. For example, the invention has applicability to non-ratchet tools as well, adjustable jaw wrenches, combination wrenches, box wrenches, socket wrenches, and screwdrivers of all known types.

2. Description of the Prior Art

There are a number of known prior expedients in the same general field, but it is believed none of them have the same full combination of advantages as the present invention. There are many patents with linear or angular extensions for wrenches and other hand tools, but without the universality and flexibility of the present invention.

U.S. Pat. No. 5,911,798 is an example of an extensible handle, ratchet, and detent fastening for the extension, but it is only linear in extension. U.S. Pat. No. 5,960,684 discloses an angled extension and square pegs. U.S. Pat. No. 6,112,625 shows a snap-in extension arm. U.S. Pat. No. 6,000,299 discloses a modular system with an intermediate adjustable extension arm. U.S. Pat. No. 6,382,058 teaches a handle that may have multiple joints. U.S. Pat. Nos. 4,586,406, 5,109,737, 5,570,617, and 5,690,006 all disclose various kinds of telescoping extensible handles but are only for straight line extension. U.S. Pat. Nos. 5,230,263 and 6,286,396 disclose angled extensions. U.S. Pat. No. 5,305,668 shows a structure to permit use of a wrench in tight quarters by providing a series of pivoted links. None of these patents suggest the present invention's system of bars and adapters or its utility of handling both angular and linear displacements and of great flexibility of application to different environments.

SUMMARY OF THE INVENTION

The prime field of use for this invention is in handling a box wrench, open wrench, or socket wrench, in tightening or loosening bolts or nuts which are located in awkward or constricted or generally hard-to-reach places. Such situations occur often in connection with the repair or maintenance of engines in heavy equipment, as earth moving equipment, boats, automotive vehicles, aircraft and the like.

It is an object of this invention to provide a flexible adaptable tool for access in constricted areas. More particularly, the invention contemplates what may be described as the working tool element (that is, the element which includes the jaws for example), and a varying set of extension bars adapted to be removably affixed to the working tool element and to each other, providing a choice of lengths and angles between the hand of the user and the bolt or nut or other structure to be manipulated. Multiple angular and linear displacements between the device to be manipulated (as a bolt) and the user's hand are provided for in this invention. Another aspect of this invention is the provision of a plurality of adapters enabling the removable affixation of other elements of the invention at different lengths and angles.

The entire assembly is referred to herein as an adaptable hand tool. That part of the assembly which includes the jaws (or other manipulating device) as an integral part is referred to herein as a working tool element.

Examples of working tool elements are a modified (as hereafter explained) ratchet wrench element and a double-ended working tool element with box wrench jaws at one end and open wrench jaws at the other end. The working tool element has wrench jaws and an extended shaft. A ratchet wrench with a shaft and a double-ended box/open wrench with a shaft are of course in themselves conventional and known. The ratchet wrench expedient may be provided with a conventional standard ratchet extension bar.

In the invention, the shaft is provided with one, two or three holes spaced along the length of the shaft. Preferably the holes are square for strength. Preferably, the double-ended wrench has three holes, one in the middle of its length and the others spaced closer to the ends. Preferably, the ratchet wrench, which typically has a shorter shaft, needs only one hole.

A set of extension bars is provided. Typically as an example, three such bars of varying length make up the set. Each extension bar preferably has an eight-pointed star-like configured set of notches comprising a hole at each end.

A set of adapters is provided, one adapter connecting each element to another. The adapter is a square plug at both ends. The plug fits into either a square hole in the working tool element shaft or the plug's corners fit into one of the extension bar's hole notches.

Preferably, means are provided to prevent the adapters from inadvertently falling out of the holes. This means is a spring-loaded detent ball protruding from the plug at each end of the adapter. A corresponding recess to detachably receive the detent is provided on each face of a square hole. On a star-like hole with notches, a circumferential groove through the notches at mid-point of the length of the notch is provided.

The tool of this invention is more comfortable in use and is able to manipulate bolts and nuts with less effort in hard-to-maneuver areas than is available with other known expedients. The user may extend safely in any angled direction and at any length extension. It's use will remove the necessity of using pipe extension or double wrenches in manipulating bolts, nuts or hydraulic lines. Thus, safety is enhanced. The tool of this invention is mechanically simple and economical to manufacture.

An economic advantage of this invention is that existing devices may be modified, as by providing a hole or holes, to make elements comprising part of the invention. Thus, existing hand tools, specialized or not, may be made more efficient, safer and more versatile by applying this invention.

DESCRIPTION OF THE PREFERRED EMBODIMENTS

Figure 1:
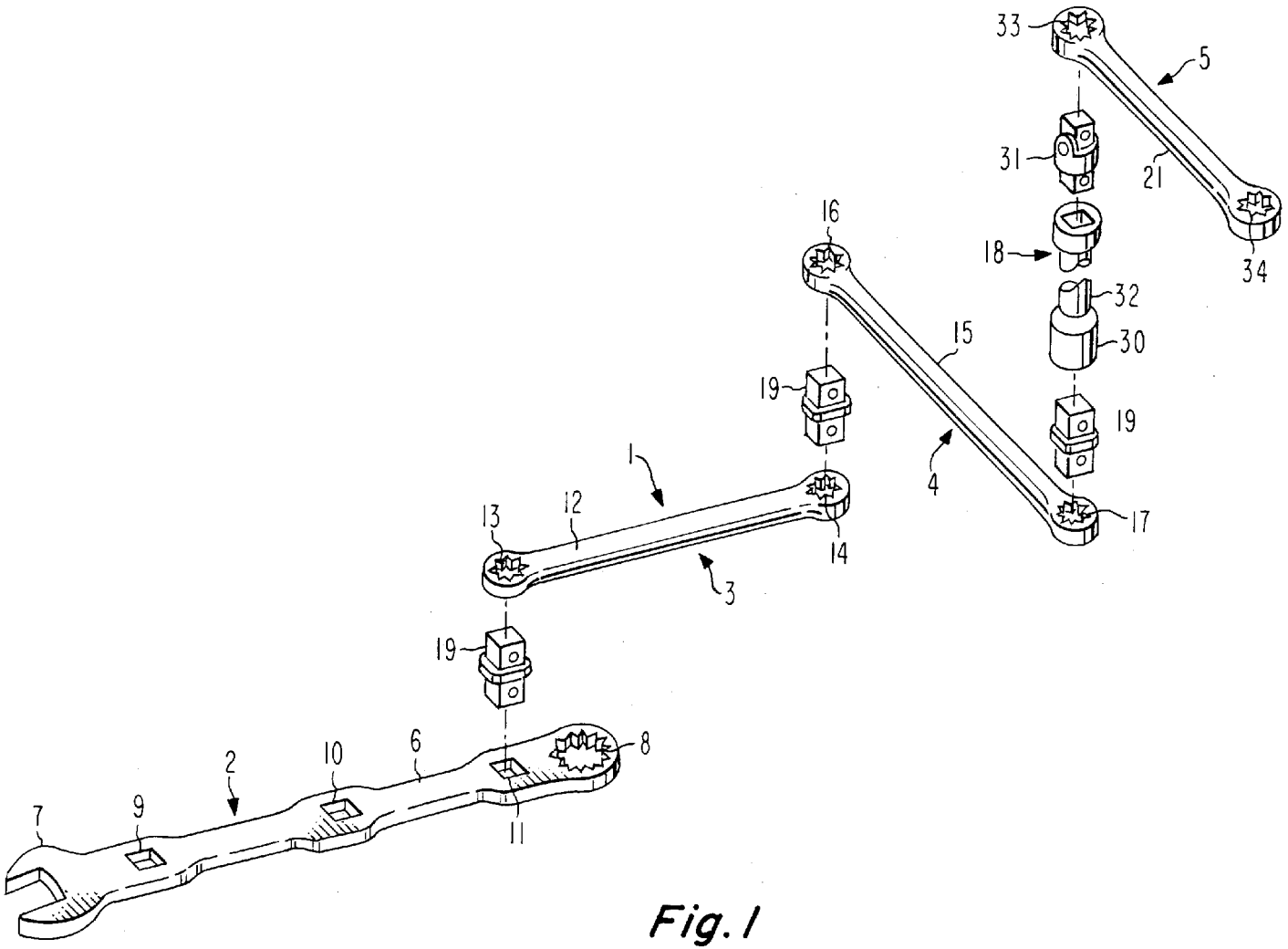
FIG. 1 is a perspective view of a typical configuration of the adaptable hand tool with the elements shown exploded.
Figure 2:
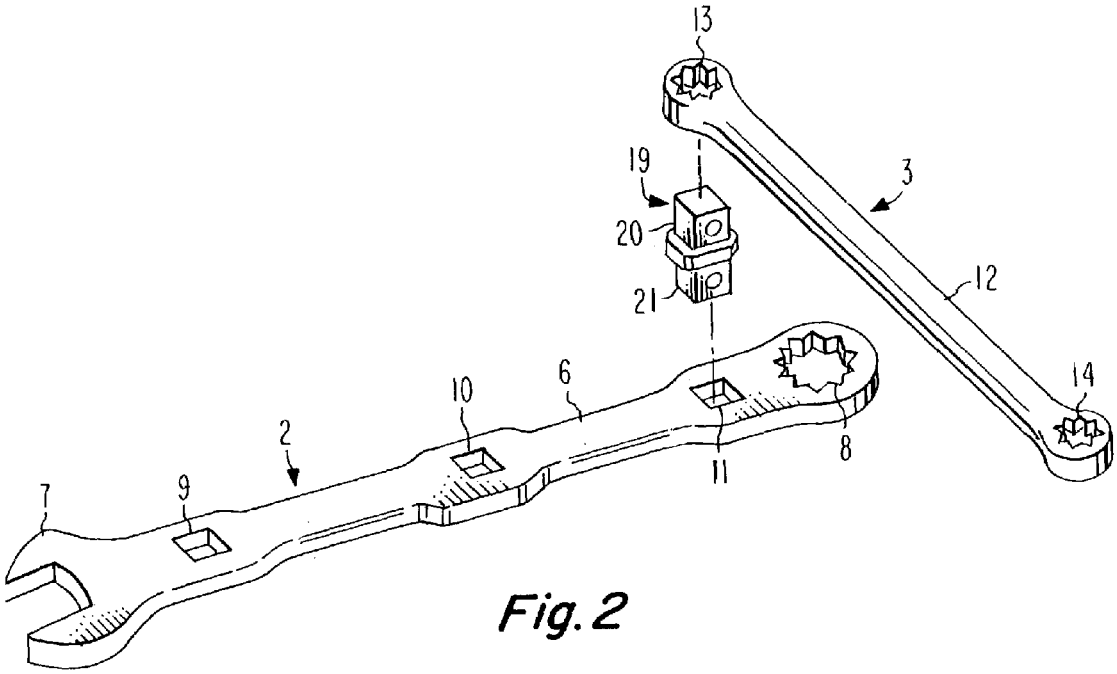
FIG. 2 is a perspective view of a typical working tool element, adapter, and extension bar with the elements shown exploded.

The invention may be best initially understood in connection with FIGS. 1 and 2. FIG. 2 shows a single extension bar element generally designated 3 in an exploded assembled relationship with a working tool element generally designated 2. An adapter, generally designated 19, interconnects the bar 3 and working tool 2.

The bar 3 has a shaft 12 and an eight-notched star-like hole 13 at one end thereof and an identical eight-notched star-like hole 14 at the other end thereof.

Figure 5:
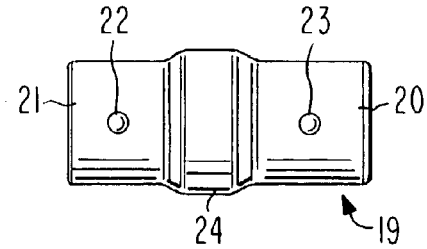
FIG. 5 is a side view of an adapter.

The adapter 19, described with more particularity in connection with FIG. 5, has a square plug 20 at one end thereof and an identical square plug 21 at the other end thereof. a raised chamfered shoulder 24 separates the end plugs. Any corner of the plug 20 can fit into any of the eight notches in hole 13. The notches are arranged at regularly spaced intervals around the generally circular circumference of the hole 13. Thus, there are eight possible orientations of the plug 20 with the hole 13, each orientation displaced 45 degrees from its neighbor.

The other plug 21 on adapter 19 is configured to fit into a corresponding square hole 11 on the working tool 2. Thus, there are available eight different angle orientations between the working tool 2 and the extension bar 3.

As may best be seen in FIG. 1, in a typical embodiment of an adjustable hand tool assembly generally designated 1, a plurality of extension bar elements may be serially affixed to each other. Such bars may be of different lengths. For example, extension bar element 3 is shorter than the extension bar element generally designated 4. It will be apparent that an end-to-end assembly of a plurality of extension bars, each of a chosen length, and each affixed to the adjacent bar at a chosen angle, may be provided. A typical set of extension bar elements may provide bar elements of 10½", 7½" and 4½" length. A working tool with wrenches at each end may be 12½" long and a working tool with a ratchet wrench at one end may be 9½" long. These dimensions are not given to be limiting but to provide a concept of one working environment and to give a sense of typical scale.

The working tool element 2 and its relationship to extension bar 3 is understood in more detail in connection with FIG. 2. Working tool element 2 comprises a shaft or body 6. At one end an open jaw wrench 7 is provided; at the other end, a twelve-notched box wrench 8 is provided. It is understood that the box wrench aperture is not intended to and cannot interconnect with an adapter 19. Working tool element 2 may be a modified converted conventional hand tool, modified by the provision of the three holes 9, 10, and 11. Apart from the assembly of this invention, this modified tool can still be used by itself in a conventional way as a box wrench or open jaw wrench. By providing the holes and utilizing tool element 2 in the assembly of this invention, a whole selection or kit of specialized tools is obviated.

A centrally positioned square hole 10 is provided in shaft 6, and identically sized square holes 9 and 11 respectively are provided on shaft or body 6 nearer the open wrench end 7 and the box wrench end 8. The square plug 21 on the adapter 19 is configured to fit into the square hole 11 on working tool 2, and in FIG. 2 it is shown in exploded position to be inserted into hole 11. The adapter plug 21 may be inserted into any of square holes 9, 10, or 11, as desired.

The extension bar element 3 has a shaft or body 12 and a eight-notched star-like aperture or hole 13 and 14 at the ends of shaft 12. While the apertures in extension bars are provided with the multiple notches as has been described, it is not necessary or desirable to provide such multiple notches in the apertures in the working tool 2. The full range of available angle displacements is attained by having star-like apertures only on the extension bars. Furthermore, it has been found that a square hole on the working tool provides greater strength and stability.

FIG. 1 better shows an example of an assembly of extension means or bars or the like. In addition to extension bar 3 as described above, another extension bar 4 is provided, and may be of a different length. Extension bar 4 has an eight-notched star-like configured aperture 16 near one end thereof. A adapter bar 19, as has been described, is provided between extension bars 3 and 4. One of the square plugs on the adapter 19 fits into the aperture 14 on bar 3. Any corner of the square plug can fit into any of the eight notches in aperture 14, thus providing a choice of 45 degree angular displacements, as has been described.

The other square plug on adapter 19 in FIG. 1 fits into the aperture 16 on bar 4 in the same manner as described above. It is apparent that this series of bars may be continued, thus varying the length and angular displacement between working tool and the user's hand.

In FIG. 1, as an example, a third extension bar 18 is provided. Bar 18 is specialized in form and may be described as a spindle. It has a shaft or body 32. At one end it has a socket 30 comprising a square hole configured to fit a plug on adapter 19. At the other end it has a square plug swivel 31, configured to fit into a notch in the eight-notched star-like aperture 33 on extension bar 5. Extension bar 5 has another eight-notched star-like aperture 34 at the other end thereof. In this assembly, the extension bar 5 is acting as a handle to be turned by the user. Also, in this assembly, it is seen that use of spindle 18 permits an extension in a vertical dimension as well as the horizontal dimension provided by bars 3 and 4. Broadly, the use of spindle 18 permits a right-angle displacement or a displacement in a dimension normal to the plane of extension bars 3 and 4.

Figure 3:
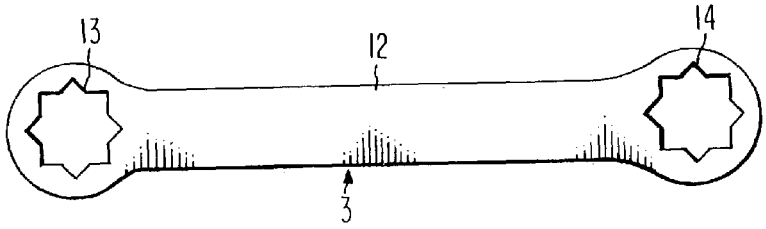
FIG. 3 is a plan view of a representative extension bar element.
Figure 4:
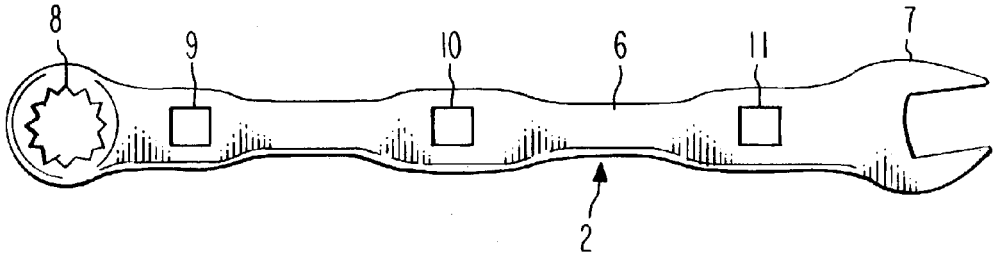
FIG. 4 is a plan view of a working tool element having a box wrench end and an open wrench end.

FIG. 3 is a more detailed plan view of a typical extension bar 3 with shaft or body 12 and eight-notched star-like apertures 13 and 14 at the ends thereof. FIG. 4 is a more detailed plan view of a working tool 2 with shaft or body 6, a box wrench 8 at one end, an open jaw wrench 7 at the other end and a set of three square holes 9, 10, and 11, spaced along the shaft with hole 10 being centrally located and holes 9 and 11 located closer to opposing ends of shaft 6.

FIG. 5 is a more detailed plan view of an adapter 19, showing the square plugs 20 and 21 at opposing ends of the adapter. This view also shows the spring-loaded detent 22 on plug 21 and spring-loaded detent 23 on plug 20. These detentes are in themselves conventional and common and are not shown herein in detail. They are a common provision in snap-in types of fittings to provide a degree of resistance to detachment, which resistance can be overcome when desired. Conventionally, the aperture into which a device with a spring-biased detent is to be inserted, is provided with a shallow recess to receive the detent. In the present invention, each face of each square hole in any element is provided with such a recess. In the present invention, the same or an equivalent function is obtained in connection with the multiple notched star-like apertures. This is accomplished by providing a circumferential groove around the inside of the notched aperture, equally spaced from each end of the aperture. The reason for providing such detent means is to inhibit accidental disassembly of the elements. The shallow recesses, circumferential grooves and the springs and detailed illustrations of the usually ball-like detentes are not shown or described in detail. They are useful matters of known mechanical design in and of themselves.

Figure 6:
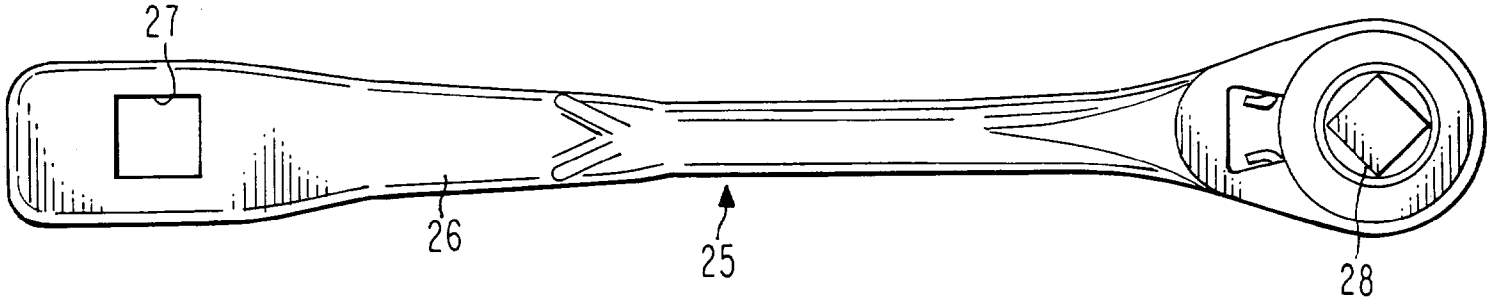
FIG. 6 is a plan view of a working tool element having a ratchet wrench end.

FIG. 6 is a plan view of another type of working tool 25. It comprises a shaft or body 26, a square hole 27 at one end and a ratchet wrench 28 at the other end. Working tool 25 may be a modified conventional ratchet wrench, modified by the provision of square hole 27. It is understood that conventional ratchet wrenches may be available with an open jaw wrench at one end and a ratchet at the other. Such a wrench may also be modified for use as in this invention by providing a hole 27.

Figure 7:
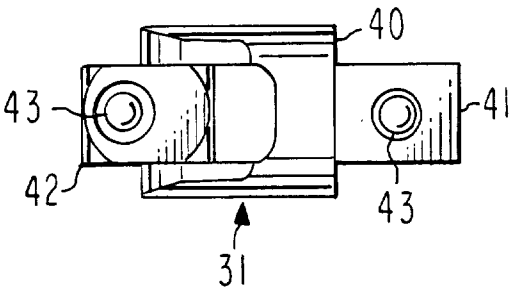
FIG. 7 is a plan view, partially fragmented, of a square plug swivel.

The embodiment using the square plug swivel 31 as shown in the typical or representative adjustable hand tool assembly 1 in FIG. 1, is itself shown in more detail in FIG. 7. Swivels have been known and used in connection with conventional extension bars. Such known swivels are believed to be double swivels, that is, acting like a universal joint. The swivel 31 in the present invention is a single swivel. The flexibility inherent in the present invention provides enough handling and positioning options as to not require a double swivel. Furthermore, a double swivel does not have the stability that the preferred single swivel has in this invention.

In FIG. 7, the square plug single swivel has a square plug 41 at one end and a square plug 42 at the other end. Each plug is provided with a spring-loaded conventional detent 43. Plug 42 is mounted for swiveling with respect to swivel body 40 by a conventional pin or axle, shown in part by the partially fragmented illustration of the swivel body 40. As best appreciated from FIG. 1, a swivel square plug on swivel 31 may be inserted into the square hole at the end of spindle 18 in either of two 90 degree angularly displaced orientations. In conjunction with the flexibility of the assembly 1, it has been found that this insertion choice is adequate to provide the user with enough working room while still providing the stability gained by using a single swivel, which does not twist in an undesired plane.

The invention may be described in somewhat broader terms. An adjustable hand tool assembly generally designated 1 comprises a single working tool 2 or 25 including a shaft 12 or 26, with the shaft having at least one hole 9 or 11 or 27 therein adapted to receive a plug 20, 21, 42 or 43.

There is at least one extension bar 3, 5 or 15, with the extension bar having a hole 13, 14, 16, 17, 33, or 34 with a multi-notched star-like circumference at each end of the bar, each hole being adapted, sized and configured to receive a plug 20. 21, 42, or 43 in selected multiple angular orientations. The preferred and most useful of the multi-notched star-like circumferences is to have eight equally spaced notches. In the working tools, the plug-receiving hole may be either a four-point (square) hole, which is preferred because of the greater strength and stability, or eight-point.

An important aspect of the invention is the provision of at least one adapter 19 or 31, the adapter comprising a plug 20, 21, 42, or 43 at each end of the adapter and a raised shoulder 24 separating the end plugs, each of the plugs being adapted, sized and configured to fit firmly and removably into any of the working toll shaft holes or extension bar holes. The corners of the plugs fit into In the case of the swivel 31 as shown in FIG. 7, the motion-limiting and stress-reducing function of the shoulder is carried out by the swivel body 40 which may be considered a raised shoulder.

The planar extension bars exemplified by general reference numerals 2, 3 and 5 have their multi-notched star-like circumference holes lying in the same plane as the shaft or long dimension of the extension bar element. The spindle extension bar element generally designated 18 has its multi-notched star-like circumference holes lying perpendicular or normal to the long dimension of the spindle extension bar element 18.

The scope of this invention is determined by the Claims.

What is claimed is:

1. An adjustable hand tool assembly comprising:

a single working tool element, including a shaft, said shaft having at least one hole therein adapted to receive a plug, at least one extension bar element, said extension bar having a hole with a multi-notched star-like circumference at each end thereof, each said hole being adapted, sized and configured to receive a plug in selected multiple angular orientations, an adapter, said adapter comprising a plug at each end thereof and a raised shoulder separating said end plugs, each of said plugs being adapted, sized and configured to fit firmly and removably into any of said working tool shaft hole or said extension bar holes, wherein there are a plurality of said extension bars and a said adapter is provided between said working tool and each said extension bar, one of said adapters removably connecting said working tool to a said extension bar and one of said adapters removably connecting each said extension bar to another said extension bar, wherein each said adapter plug has corners and is square in configuration, wherein the said corners of said adapter plugs fit firmly and removably into selected said notches, whereby different angular displacements between said elements is selectable by the user, wherein at least one of said extension bars is of a different length than another of said extension bars, whereby accommodation to available working space is facilitated, wherein each of said adapter plugs is provided with a spring-loaded detent, and each of said holes is provided with a recess sized and configured to accommodate a said detent, whereby firm but removable engagement between said elements is facilitated.

2. An adjustable hand tool assembly comprising:

a single working tool element, including a shaft, said shaft having at least one hole therein adapted to receive a plug, at least one extension bar element, said extension bar having a hole with a multi-notched star-like circumference at each end thereof, each said hole being adapted, sized and configured to receive a plug in selected multiple angular orientations, an adapter, said adapter comprising a plus at each end thereof and a raised shoulder separating said end plugs, each of said plugs being adapted, sized and configured to fit firmly and removably into any of said working tool shaft hole or said extension bar holes, wherein said hole in said working tool shaft is a square hole, whereby the strength and stability of the said working tool connection to a said extension bar is enhanced, wherein each said multi-notched star-like circumference hole is provided with eight equally spaced notches, whereby a selection of 45 degree angular displacements is provided.

3. An adjustable hand tool assembly as set forth in claim 2 wherein said working tool element is a ratchet wrench and is provided with a single square hole.

4. An adjustable hand tool assembly as set forth in claim 3 wherein said working tool element has at least one of an open jaw wrench and a box wrench at the ends thereof.

5. An adjustable hand tool assembly as set forth in claim 4 wherein said working tool element is provided with three square holes, one said holes being centrally located.

6. An adjustable hand tool assembly comprising:

a single working tool element, including a shaft, said shaft having at least one hole therein adapted to receive a plug, at least three extension bar elements, each said extension bar elements having a hole with a multi-notched star-like circumference at each end thereof, each said hole being adapted, sized and configured to receive a plug in selected multiple angular orientations, at least two of said extension bar elements being planar and having said holes with a multi-notched star-like circumference lying in the same plane as the long dimension of said extension bar element, a single extension bar element configured as a spindle and having said holes with a multi-notched star-like circumference lying in a plane perpendicular to the long dimension of said extension bar spindle element, an adapter between each extension bar element, said adapter comprising a plug at each end thereof and a raised shoulder separating said end plugs, each of said plugs being adapted, sized and configured to fit firmly and removably into any of said working tool shaft hole or said extension bar holes, wherein one of said planar extension bar elements serves as a handle for the user, and the said adapter connecting said handle to said spindle extension bar element is a single swivel, said swivel having a body with said plugs at the ends thereof, said swivel body serving as a shoulder between said plugs, wherein each said adapter plug has corners and is square in configuration, wherein the said corners of said adapter plugs fit firmly and removably into selected said notches, whereby different angular displacements between said elements is selectable by the user, wherein the said corners of said adapter plugs fit firmly and removably into selected said notches, whereby different angular displacements between said elements is selectable by the user, wherein at least one of said extension bars is of a different length than another of said extension bars, whereby accommodation to available working space is facilitated, wherein each of said adapter plugs is provided with a spring-loaded detent, and each of said holes is provided with a recess sized and configured to accommodate a said detent, whereby firm but removable engagement between said elements is facilitated.

* * * * *